United States Patent [19]

Gill

[11] Patent Number: 4,548,168

[45] Date of Patent: Oct. 22, 1985

[54] THREADED TAPPET ADJUSTER

[75] Inventor: Peter J. Gill, Wolverhampton, England

[73] Assignee: GKN Screws & Fasteners Limited, Wednesbury, England

[21] Appl. No.: 596,668

[22] Filed: Apr. 4, 1984

Related U.S. Application Data

[63] Continuation-in-part of Ser. No. 366,050, Apr. 6, 1982, abandoned, which is a continuation-in-part of Ser. No. 120,492, Feb. 11, 1980, abandoned.

[30] Foreign Application Priority Data

Jan. 12, 1980 [GB] United Kingdom ..... 8001089

[51] Int. Cl.[4] ..... F01L 1/22

[52] U.S. Cl. ..... 123/90.54; 123/90.45

[58] Field of Search ..... 123/90.45, 90.48, 90.52, 123/90.53, 90.54

[56] References Cited

U.S. PATENT DOCUMENTS

| | | | |
|---|---|---|---|
| 1,907,631 | 5/1933 | Warren | 123/90.45 |
| 2,131,507 | 9/1938 | Goodwin | 123/90.54 |
| 2,211,585 | 8/1940 | Rushmore | 123/90.54 |
| 2,283,536 | 5/1942 | Burkhardt | 123/90.54 |
| 2,320,385 | 6/1943 | Rockstroh | 123/90.54 |
| 2,642,049 | 6/1953 | Russell | 123/90.54 |
| 2,693,790 | 11/1954 | Ralston | 123/90.54 |
| 2,713,856 | 7/1955 | Turley | 123/90.54 |
| 3,118,322 | 1/1964 | Oldberg et al. | 123/90.54 |

FOREIGN PATENT DOCUMENTS

| | | | |
|---|---|---|---|
| 0001199 | of 1905 | United Kingdom | 123/90.54 |

*Primary Examiner*—Ira S. Lazarus
*Assistant Examiner*—R. S. Bailey
*Attorney, Agent, or Firm*—Marshall, O'Toole, Gerstein, Murray & Bicknell

[57] ABSTRACT

An automatic tappet adjuster for a valve operating mechanism has two components 12, 14 with co-operating buttress thread form screw threads 32. The axial free play in the threads 32 sets the valve clearance. Excess clearance 56 is taken up by movement of one component, 14 acted on by a spring 40, relative to the other component 12. The buttress thread form 32 exhibits higher friction against rotation in one direction than in the other.

3 Claims, 10 Drawing Figures

THREADED TAPPET ADJUSTER

This application is a continuation-in-part of our application Ser. No. 366,050 filed Apr. 6, 1982 now abandoned, which is itself a continuation-in-part of our application Ser. No. 120,492 filed Feb. 11, 1980 now abandoned.

BACKGROUND TO THE INVENTION

This invention relates to an automatic valve clearance adjuster for a valve operating mechanism.

It is well known to provide a mechanical valve clearance adjuster for an internal combustion engine valve gear with a screw thread which must be manually adjusted at regular intervals to give the correct clearance in the valve mechanism. It is also well known to use a hydraulic tappet in a valve mechanism to provide self adjustment by means of pressurised oil located between two parts which move relative to each other, changes in the quantity of pressurized oil compensating for any wear. In a hydraulic tappet, movement between the two parts of the tappet controls a hydraulic connection to the interior of the tappet and thereby controls the volume of trapped oil and hence the valve clearance.

It is also from UK patent specification No. 510864 to provide a hydraulic tappet which can be modified to use a coarse pitch screw thread for controlling the hydraulic connection to and the volume of oil in the interior of the tappet. The thread has clearance representing the desired clearance in the valve operating mechanism. It also has a steep flank on one side of the threadform to produce low friction and allow adjustment by relative rotation of the threaded parts in response to an axial spring load when the valve operating load is removed. The opposite flanks are steeply angled to provide a wide flat surface to accomodate the ends of oil passages which can be closed off at the screw thread by taking up the thread clearance in the direction of valve operation. As the oil passage become closed, a hydraulic lock develops within the tappet and the pressure of the oil in the closed interior of the tappet transmits the valve operating load between the two parts of the tappet.

Mechanical tappet adjusters are also known wherein co-operating relatively rotatable screw threaded components are biased relative to one another by means of torsion springs. The torsion springs act to rotate one component relative to the other to provide corresponding relative axial movement and consequent take-up of undesirable excessive free play in the valve operating mechanism. However such take-up tends to eliminate all the free play in the valve operating mechanism and additional means have to be provided to limit the take-up to the desired controlled clearance.

An object of the invention is to provide a simple mechanical (as opposed to hydraulic) system for adjusting clearance in a valve operating mechanism for an internal combustion engine.

SUMMARY OF THE INVENTION

The invention provides a valve operating mechanism for a valve of an internal combustion engine, the mechanism including an automatic clearance adjuster between two components of the mechanism, the components having co-operating screw threads which exhibit a predetermined axial free play, the components being axially spring loaded with respect to each other in a sense opposite to the transmission of valve operating forces between the components, such that when no valve operating force is being transmitted the spring loading urges the threads axially into engagement and causes relative rotation of the components so that they take up rotational positions such that the clearance in the mechanism is equal to the axial play in the screw thread, characterised in that the screw thread exhibits a high friction in one direction of axial loading compared with the friction in the opposite direction of axial loading and that the valve operating forces are transmitted between the screw threads in the higher friction direction so that the friction serves to prevent relative rotation between the components during valve actuation.

A fundamental difference between the present invention and one example of the above mentioned prior art is the high friction developed between the screw threads of the present invention during valve actuation to ensure that correct adjustment is maintained and that positive valve operation is achieved. This contrasts with the prior art of UK patent 510,864 where both the large volume of oil supplied direct to the screw thread and the oil pressure within the tappet prevents firm seating between the two parts of the thread.

Preferably said co-operating screw threads have buttress thread forms which are carefully optimised wherein the thread form of each said component has a helix angle H, a first flank angle $G_R$ and a second flank angle $G_L$ satisfying the conditions that (a) $\tan H > \mu_{MAX} \sec G_R$; (b) $\tan H < \mu_{MIN} \sec G_L$ and (c) $\cot G_L > \mu_{MAX} \cos H$ where $\mu_{MAX}$ and $\mu_{MIN}$ are respectively the highest and lowest expected values of the co-efficient of friction between the co-operating flanks of the threads of said components.

Valve clearance adjustment is generally more difficult to achieve with an overhead camshaft layout than with a pushrod layout due to the lack of space available with an overhead camshaft arrangement. This makes an automatic clearance adjuster particularly desirable but also causes problems in the design of a suitably compact automatic clearance adjuster.

According to a further feature of the present invention there is provided a valve operating mechanism for an overhead camshaft operated valve of an internal combustion engine, the mechanism including a bucket-type tappet and an automatic clearance adjuster between an adjuster sleeve bearing against the tappet and the stem of the valve, the stem and sleeve having the co-operating screw threads, the sleeve being spring loaded with respect to the stem in a sense opposite to the transmission of valve operating forces between the sleeve and stem.

Preferably access holes are provided in the edge of the tappet to permit manual rotation of the sleeve for setting up the mechanism.

Preferably the spring acts on the sleeve through a ball member in order to prevent the spring from affecting relative rotation between the sleeve and stem.

Preferably the engagement between the cam and the tappet is such as to tend to rotate the tappet and the adjuster sleeve in a direction to tend to increase valve clearance. This rotational tendency should preferably be provided only when the cam is in a position corresponding to a closed valve and may be provided by an off-set of the cam surface which engages the tappet. This off-set may be provided by a chamfer to remove part of the cam surface.

It is desirable to provide for a main valve stem to extend as far as possible into the tappet in the interests of reducing the overall length of the valve mechanism to a minimum and thereby keeping the height of the engine to a minimum. The existence of the adjuster mechanism within the bucket interferes with the normal extension of the spring to a reaction point well within the tappet. A valve spring reaction sleeve may be secured to the valve stem at a position nearer to the valve head than the adjuster sleeve, extends around the sleeve into the tappet and has an external flange within the bucket to provide a reaction point for the main valve spring.

BRIEF DESCRIPTION OF THE DRAWINGS

The invention will now be described by way of example only with reference to the accompanying drawings in which.

DESCRIPTION OF PREFERRED EMBODIMENTS

Figure 1:
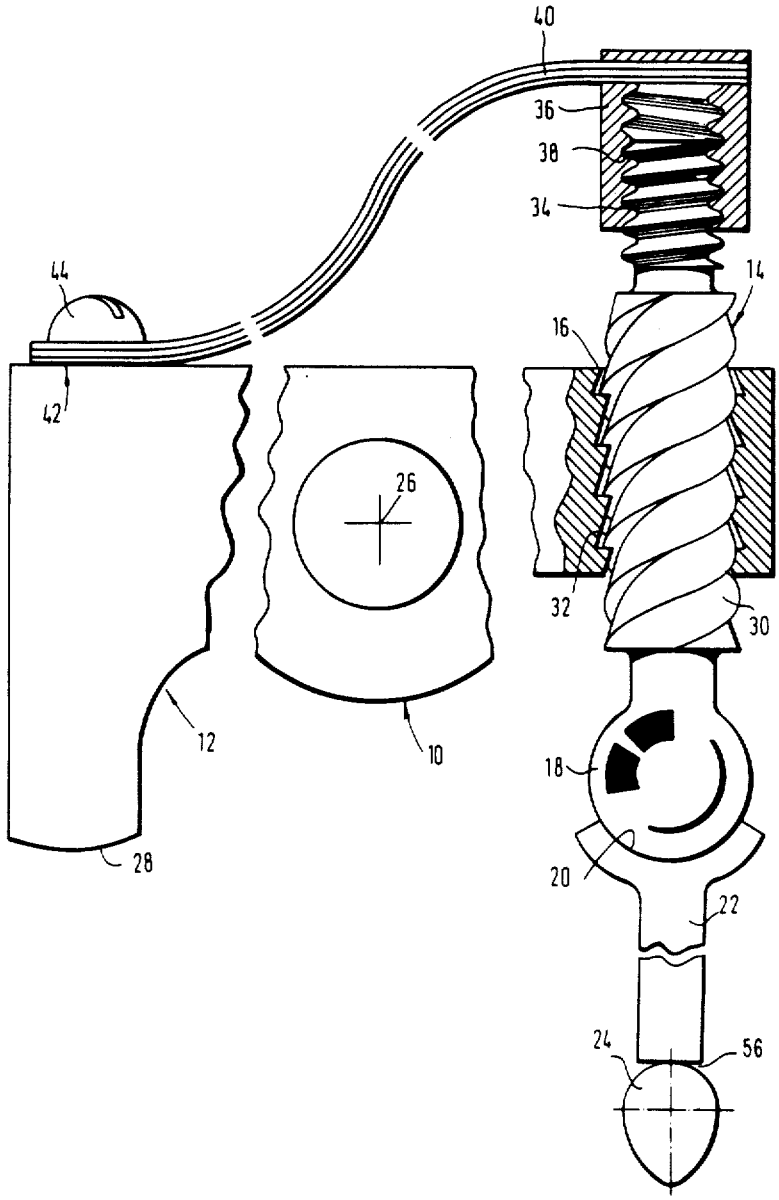
FIG. 1 is a cross sectional elevational view of an apparatus according to the invention

FIG. 1 shows a valve operating mechanism 10 which comprises two components 12 and 14 in screw threaded engagement with each other at 16. The component 14 has a ball 18 which locates in the socket 20 of a push rod 22. Oscillatory movement of the push rod 22 is provided by the action of a cam 24 positioned on a cam shaft (not shown).

This oscillatory movement of the push rod 22 is transmitted via the screw threaded engagement 16 of the component 14 to the component 12. The component 12 is a rocker arm which is pivoted about an axis 26 and is free to move in one plane only in a direction parallel to the axis of the push rod 22 about its own axis 26. The abutment 28 of the component 12 abuts the valve stem (not shown) of the valve of an internal combustion engine valve. The valve has a conventional valve spring (not shown).

The component 14 can conveniently be described in three separate parts. One part 18 abuts the socket 20 of the push rod 22 as previously described. The part next to it 30 is a threaded part which engages at 16 with the component 12. The thread 32 of the part 30 is of buttress thread form and its action will be descibed subsequently.

The other part 34 of the component 14 is also screw threaded with a fine, but preferably standard thread form. Component 34 is located in a body 36 with an internal screw thread 38. A spring member 40 is secured to the body 36, preferably by welding. The spring member 40 acts between the body 36 and the component 12 to which it is secured at 42 by fastening means 44.

The adjusting mechanism is used to automatically adjust the valve gear mechanism of an internal combustion engine to take up any excess clearance. The mode of operation will now be described with reference to FIGS. 2–4. These show a portion of the buttress thread form of both the component 12 and the component 14. For convenience component 12 will be referred to as the nut and threaded part 30 of component 14 as the screw.

Figure 2:
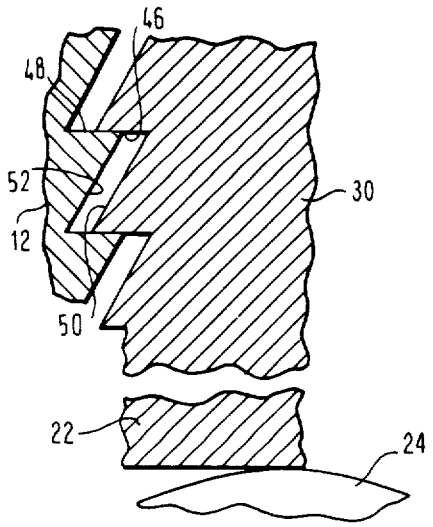
FIGS. 2 to 4 are schematic representations of the positional relationship of the thread forms of the two components to each other.

When the cam is in the rotational position shown in FIG. 2 there is no valve operating load on the screw 30. The spring means 40 therefore ensures that the faces 46 of the screw 30 and 48 of the nut 12 are in contact. Between the face 50 of the screw 30 and the face 52 of the nut 12 there is a clearance 54 in an axial direction which is the required clearance in the valve mechanism. To illustrate that there is no other clearance, the valve mechanism is shown in contact with the cam 24.

Figure 3:
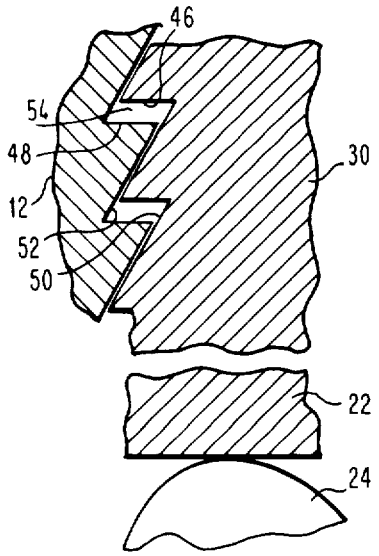

When the cam rotates it applies a load via the push rod 22 to the screw 30, which load takes effect at the junction 16 of the components. The screw moves parallel to its axis, in this case vertically upwards, giving a clearance 54 between the faces 46 and 48 as shown in FIG. 3. The faces 50 and 52 come into contact and they are wedged securely due to the particular shape of the buttress thread form. Rotational movement of the two components relative to each other is prevented by this wedging action of the buttress thread form. Consequently load can be transmitted from the push rod 22 via the components 12 and 14 to the abutment 28 and thence to the valve of the internal combustion engine.

Figure 4:
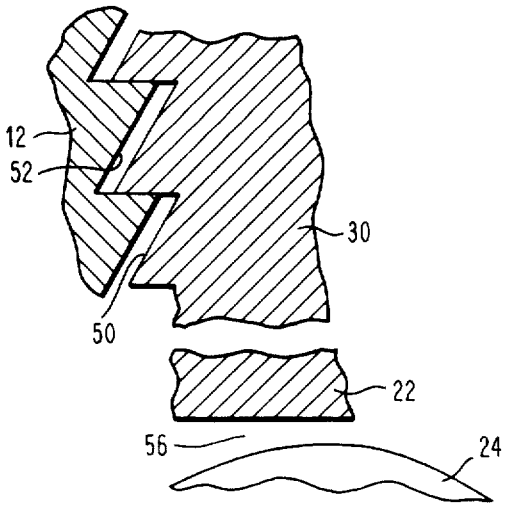

FIG. 4 shows a notional position when wear in the mechanism has occurred but no adjustment has taken place. This wear may, for example, take place at the interface 56 of the mechanism and the cam 24 and is illustrated by a gap at this interface in FIG. 4. In this situation the total clearance in the valve mechanism is the desired clearance at the junction 16 plus the additional clearance at interface 56.

In this situation the force of spring means 40 is acting in a downward direction on component 14 holding it in firm contact through the low friction faces of the screw threads 32. This friction is sufficiently low in conjunction with the coarseness of the thread 32 to cause the component 14 to rotate and move in a downward direction under the influence of the spring force. This movement continues until the whole of the gap at the interface 56 has been taken up and in that situation the configuration of the valve mechanism corresponds to that shown in FIG. 2. Thereafter the valve mechanism operates as described with reference to FIGS. 2 and 3 until such time as the clearance again increases as a result of further wear. In practice the adjustment takes place gradually as wear occurs with the result that no substantial excess clearance as shown at 56 ever occurs. In this way the valve mechanism is self adjusting and compensates for wear.

During the adjusting operation it is of course necessary for the component 14 to be able to rotate and this requires a relatively low friction in threads 38 which can be met by a conventional thread form and a fine pitch thread.

Figure 5:
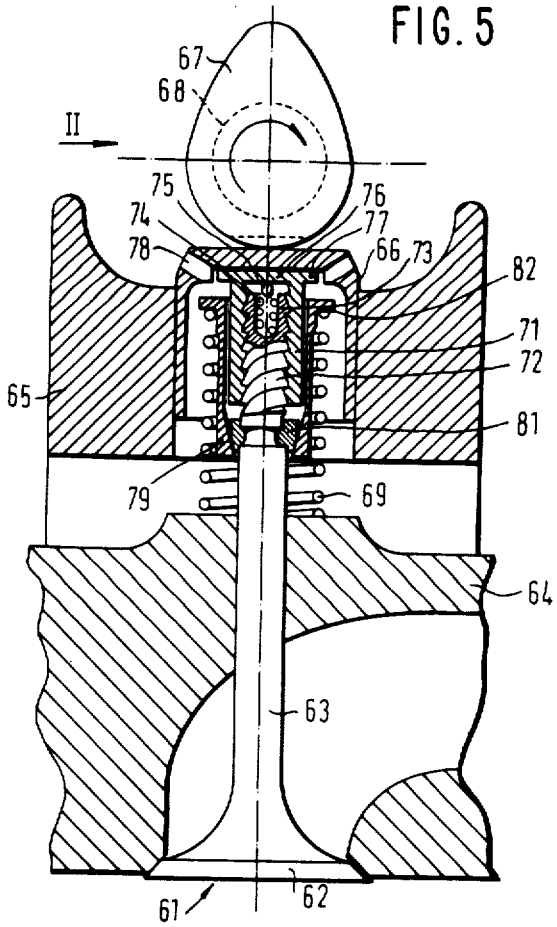
FIG. 5 is a diagrammatic cross-section through a further valve mechanism in accordance with the present invention.
Figure 6:
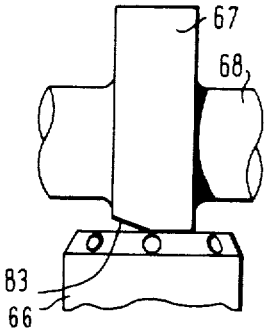
FIG. 6 is a view in the direction of arrow II of FIG. 5 showing part of the mechanism.

FIGS. 5 and 6 show an embodiment of the invention applied to the valve gear of an overhead camshaft internal combustion engine.

A valve 61 has a head 62 and a stem 63 and is guided in a cylinder head casting 64 in the usual way. The cylinder head carries a tappet guide 65 within which a bucket-type tappet 66 is slideable. A cam 67 carried on an overhead camshaft 68 is arranged in the usual way to operate the tappet 66 and thereby operate the valve 61. A main valve spring 69 serves the usual purpose of returning the valve to a closed condition when rotation of the cam 67 allows this closure. Further details of the reaction points of the valve spring 69 will be discussed subsequently.

As thus far described the mechanism is conventional and the invention is concerned with an adjuster mechanism between the valve stem 63 and the tappet 66 to provide automatically a limited clearance in the valve mechanism.

An internally screw threaded adjuster sleeve 71 cooperates with a screw thread 72 on the exterior of the valve stem 63 near the top of the valve stem. These screw threads correspond to the threads described in detail with reference to FIGS. 2, 3, and 4 and in particular they incorporate an axial clearance, higher friction in one direction of relative rotation and low friction in the opposite direction of relative rotation.

The upper end of the valve stem 63 incorporates a bore 73 within which an adjuster spring 74 is located. The adjuster spring acts in compression between the base of the bore 73 and a ball 75 which reacts on an end closure 76 of the sleeve 71. The spring thus tends to urge the sleeve 71 upwards in relation to the stem 63 to urge the screw threads into mutual contact in the low friction direction and to take up the clearance in the screw threads.

The end closure 76 of sleeve 71 bears against the tappet 66 and incorporates extensions 77 to which access is available through access holes 78 in the tappet to enable the sleeve 71 to be rotated manually when setting up the valve mechanism.

A main valve spring reaction sleeve 79 surrounds the adjuster sleeve 71 and is secured at its lower end to the valve stem 63 by conventional collets 81. Sleeve 79 extends up within the tappet 66 and at its upper end incorporates an outwardly extending valve spring reaction flange 82. The main valve spring 69 operates between the flange 82 and a seat on the cylinder head. In this way, the normal length of the valve spring 69 is substantially maintained without adding to the height of the valve mechanism as a whole.

As best seen in FIG. 6, the face of the cam is chamfered at 83 so that if the tappet 66 is in contact with the cam 67 with the cam in the rotational position shown, the cam bears on the tappet at a position off-set from its centre. Due to this, rotation of the cam tends to induce some rotation of the tappet.

The operation of the adjuster mechanism in taking up excess clearance is substantially as described in relation to FIGS. 1 and 4 and will only be explained briefly. Initially, the mechanism is set up with an excess clearance and with the cam in the position shown, i.e. with the valve seated. Spring 74 moves the adjuster sleeve 71 in an upward direction, the sleeve rotating relative to the valve stem by the effect of the low friction of the screw thread to permit this movement. This movement occurs until the tappet 66 comes into contact with the cam 67 so that the only clearance in the mechanism is the clearance within the screw threads between the stem 63 and sleeve 71. On normal operation of the valve mechanism, the threads are loaded in the high friction direction so that axial movement can be transmitted from the tappet through the screw thread to the valve to lift the valve in the usual way. If excess clearance tends to develop, this is automatically taken up by the adjuster mechanism by relative rotation between the sleeve 71 and valve stem 63.

The mechanism shown in FIGS. 5 and 6 is also capable of providing an increased clearance if the clearance of the valve mechanism should reduce below a minimum requirement. This effect is achieved by the provision of chamfer 83 which tends to cause the cam 67 to rotate the tappet 66 and with it the adjuster sleeve 71 in a direction to increase the clearance in the mechanism. This rotational tendency occurs at a time when the valve is fully seated and the force of engagement between the tappet 66 and cam 67 is merely that of the adjuster spring 74. This slight tendency to rotation during each revolution of the cam produces a sufficient bias towards an increase in clearance to prevent the clearance from becoming too small. The clearance cannot become excessively large because when the clearance becomes equal to the clearance between the screw threads, there is no further contact between the cam 67 and tappet 66 as the chamfer 83 rotates past the tappet.

Referring now to FIGS. 7–10, it has been found that, if the buttress thread forms are carefully optimised, it no longer becomes necessary to provide the additional screw-threaded parts 34 and 36.

Figure 7:
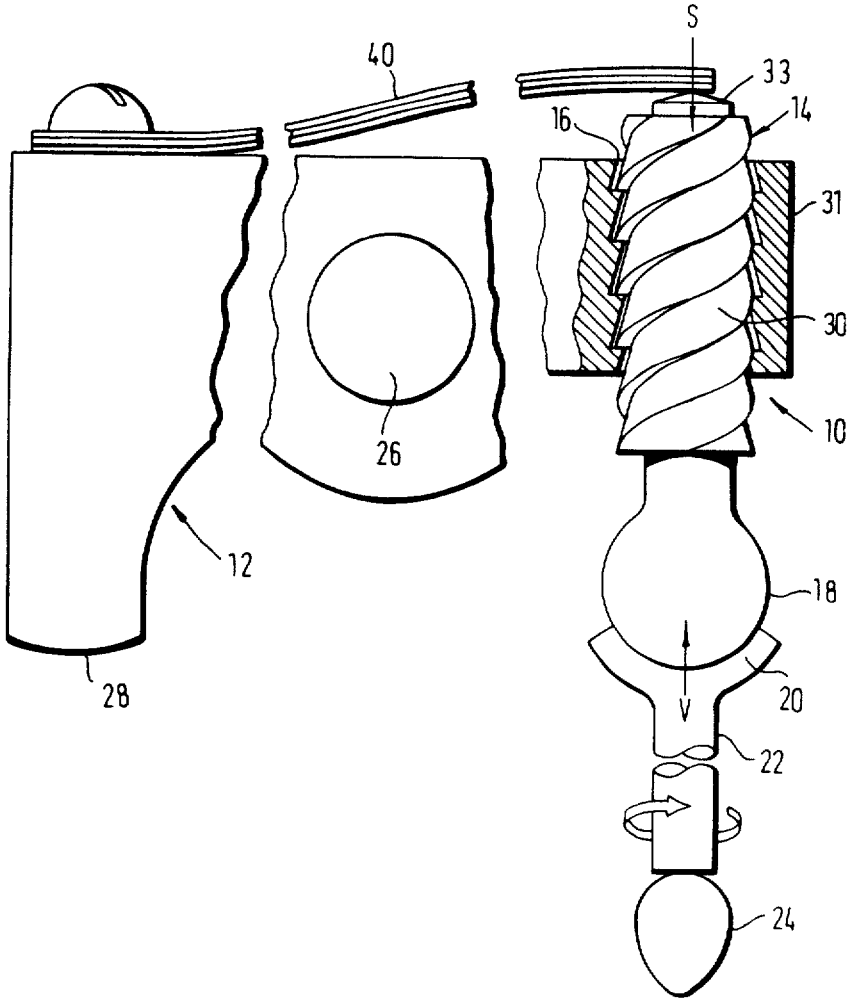
FIG. 7 is a partial cross-sectional side view of an alternative form of automatic clearance adjusting mechanism
Figure 8:
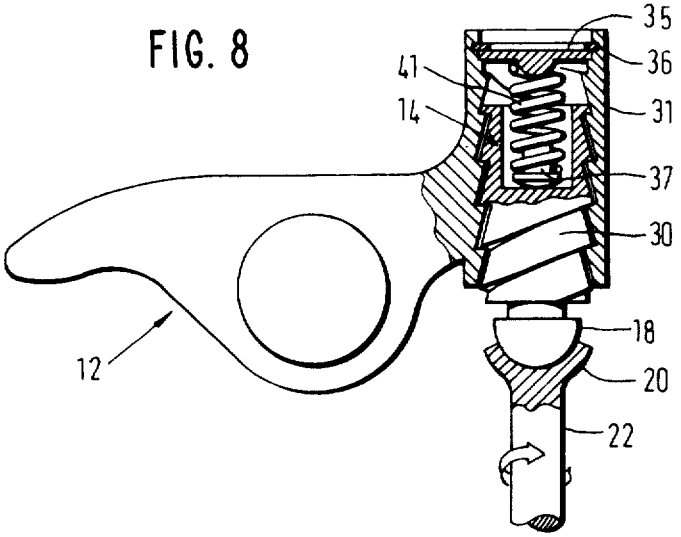
FIG. 8 is a similar partial cross-sectional side view of a modification of the mechanism of FIG. 7

A more detailed explanation of the optimisation of the buttress thread form is given below but the general arrangement of the automatic adjuster incorporating such optimised thread forms is illustrated in FIGS. 7 and 8 wherein like reference numerals refer to like parts already described herein. Thus FIG. 7 shows a valve operating mechanism 10 including the automatic clearance adjuster and comprising two components 12 and 14 in screw threaded engagement with one another at 16. The component 14 has a ball 18 located in the socket 20 of a push rod 22. Oscillatory movement of the push rod 22 is provided by the action of a cam 24 positioned on a cam shaft (not shown).

This oscillatory movement of the push rod 22 is transmitted via the screw threaded engagement 16 of the component 14 to the component 12. This component 12 comprises a rocker arm which is pivoted about an axis 26 and is free to move in one plane only in a direction parallel to the axis of the push rod 22 about its own axis 26. The abutment 28 of the component 12 abuts the valve stem (not shown) of a poppet valve of an internal combustion engine. Such valve has a conventional valve spring (not shown) which initiates closing movement of the valve onto its seat when the cam 24 is in its low radius profile position relative to the bottom of the push rod 22. Valve lifting forces are imparted to the valve by the cam 24 when it is in its high radius profile position relative to the bottom of the push rod 22.

The component 14 has a threaded portion 30 of buttress thread form in screw threaded engagement with a complementary buttress screw threaded bushing 31 of the component 12. Axially downward spring loading is imparted to the component 14 through the action of spring 40 bearing with point contact upon an upwardly projecting conical spigot 33 at the upper end of the portion 30. The axial spring loading force due to the urging of the spring 40 is designated at S in FIG. 7 whereas the valve lifting force is designated at V.

A somewhat similar arrangement is shown in the modification of FIG. 8 wherein the threaded portion 30 of component 14 is axially recessed at its upper surface and wherein the screw threaded bushing 31 of the component 12 extends axially upwardly beyond the component 14 to provide an internally screw threaded bore of greater axial length than the screw threaded portion 30. The top of the bore is closed by a cap 35 retained in position by a circlip 36 or the like and a spiral compression spring 41 acts between the cap and the threaded portion 30 to urge it axially downwardly against the direction of valve lifting forces. The compression spring 41 is conveniently located by means of a pip on the lower face of the cap 35 at the upper end of the spring and by a spigot 37 with a lower spherical bearing face at the lower end of the spring, to press upon the base of the recess in the portion 30.

In both of the embodiments of FIGS. 7 and 8 the cam 24 is shaped to impart a rotational force to the push rod 22 in the direction of the arrow during transmission of valve lifting forces. Thus, after the screw 30 has been displaced axially under the influence of spring forces S to its maximum possible extent, the aforesaid push rod rotation is transmitted to the screw 30 to urge it into the position where the thread clearances are as shown in FIGS. 2 and 7. When the valve lifting force is transmitted from cam 24, the screw 30 then has to rise through the clearance 54 before the lifting force is translated to the rocker arm.

Figure 9:
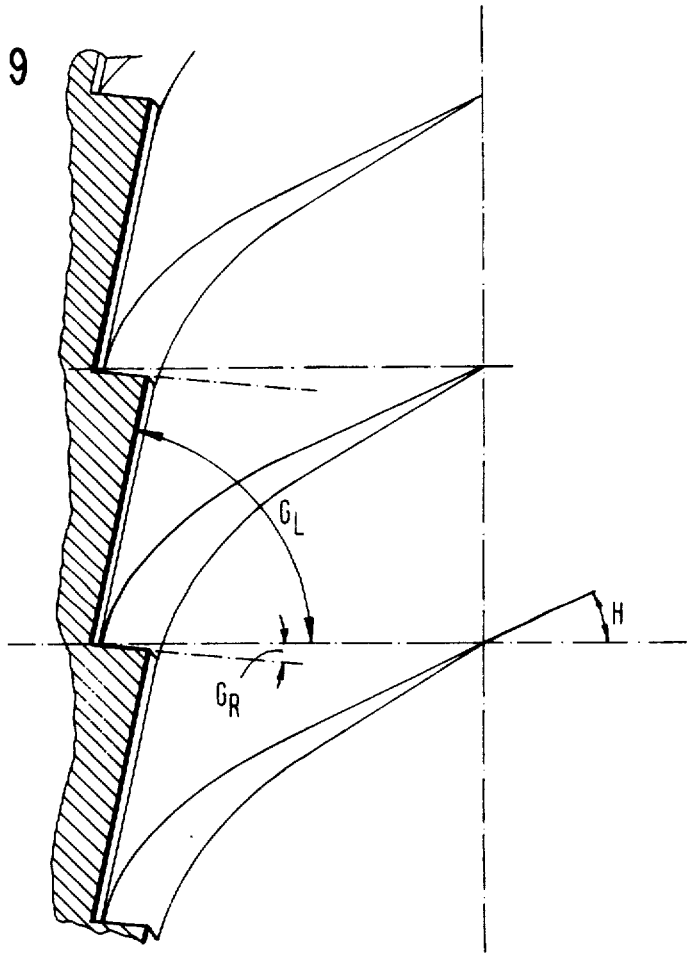
FIG. 9 is an enlarged schematic representation of the positional relationship of the thread forms of the two components of the mechanism.

Referring to the enlarged detail view of FIG. 9 it will be seen that the buttress thread forms are provided with a helix angle H; a first, or low, flank angle $G_R$ and a second, or high, flank angle $G_L$. The optimised geometry of the thread form is characterised by providing a high helix angle H of typically 10° to 20° and an asymmetric buttress thread form having a low flank angle $G_R$ of typically 0° to 5° and a high flank angle $G_L$ of typically 70° to 80°.

The actual relationship between the helix angle H, and the flank angles $G_R$ and $G_L$ is derived from three conditions which are now described with reference to the graph of FIG. 10:

Condition A

Referring to FIGS. 7 and 8, when the valve lifting force V is zero the spring force S must be able to (a) push the component 14 downwardly to cause its low angle flanks to make contact with the low angle flanks of the thread in the component 12, and (b) cause the component 14 to rotate and advance axially downwardly in the direction S in order to take up any clearance in the valve gear. This axial advance must be attainable in this way even when the co-efficient of friction is unfavourably high, for example having a value $\mu=0.2$. For this rotational and axial movement to be possible the tangent of the helix angle H must exceed the product of the secant of the flank angle $G_R$ multiplied by the co-efficient of friction i.e., $\tan H > \mu \sec G_R$.

Figure 10:
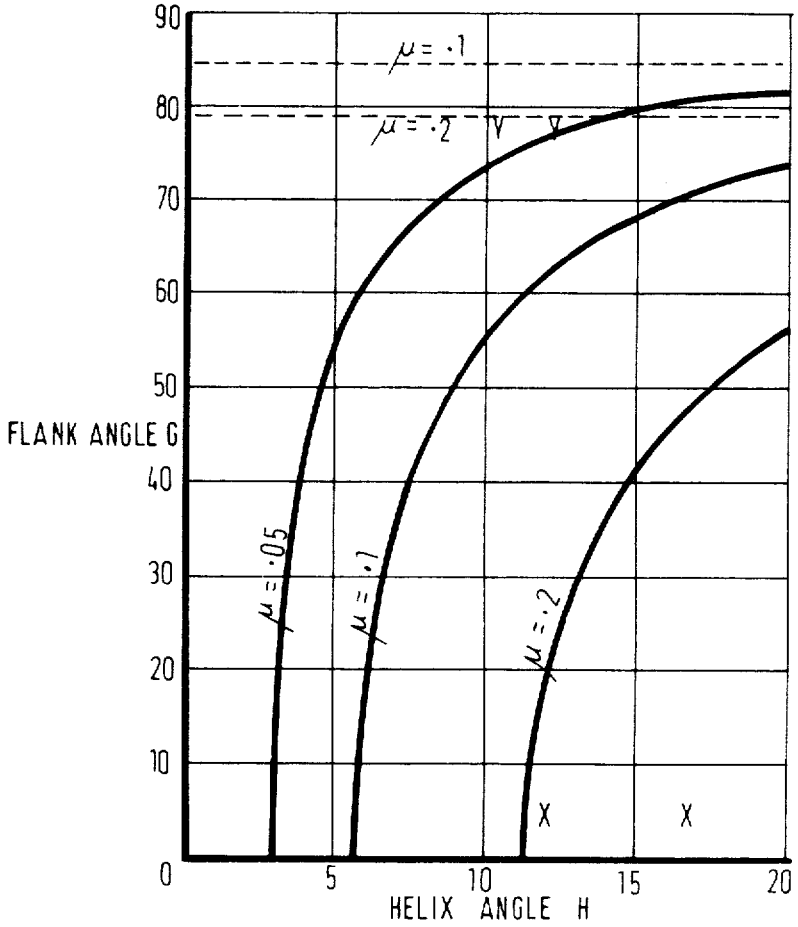
FIG. 10 is a graph relevant to the thread form plotting the flank angle against the helix angle.

This is equivalent to stating that, with reference to FIG. 10, the plot of the flank angle ($0<G_R<5°$) against the helix angle H must lie in the zone XX, i.e., to the right of the curve marked $\mu=0.2$.

Condition B

When the valve lifting force V overcomes the spring force S, and the high angle flanks of the component 14 are forced into contact with the high angle flanks of the component 12, the frictional resistance at the contacting surfaces must be sufficient to prevent the component 14 from rotating within the co-operating screw threaded bushing even when the co-efficient of friction has an unfavourably low value of example $\mu=0.05$. For the prevention of this rotation, the tangent of the helix angle H must be less than the product of the secant of the flank angle $G_L$ multiplied by the co-efficient of friction i.e., $\tan H < \mu \sec G_L$.

This is equivalent to stating that, with reference to FIG. 10, the plot of the flank angle ($70°<G_L<80°$) must lie in the zone YY, i.e., upwards and to the left of the curve marked $\mu=0.05$.

Condition C

When the valve force V is removed, the spring force S must be capable of breaking the contact which is taking place on the high angle flanks of the screw threads of the two co-operating components. In other words, the flank angle $G_L$ must be less than a value which would cause the threads to stick permanently together as a result of the action of the valve lifting force of V even when the co-efficient of friction has an unfavourably high value for example such as $\mu=0.2$. This frictional sticking can be avoided by making the co-tangent of the flank angle $G_L$ greater than the product of the cosine of the helix angle H and the co-efficient of friction i.e., $\cot G_L > \mu \cos H$.

This is equivalent to stating that, with reference to FIG. 10, the plot of the flank angle ($70°<G_L<80°$) must lie in the region YY i.e., below the dashed line marked $\mu=0.2$.

In the graph of FIG. 10 the dashed lines for the co-efficient of friction marked as $\mu=0.1$ and $\mu=0.2$ satisfy the condition $\cot G=\mu \cos H$ whereas the curves marked as $\mu=0.05$; $\mu=0.1$ and $\mu=0.2$ satisfy the condition $\tan H=\mu \sec G$.

This optimised geometry of the buttress thread forms thus enables the construction of the more simple automatic clearance adjuster of FIGS. 7 and 8 which will function in the manner described herein without the need for the additional screw threaded parts 34–36 which were described with respect to FIG. 1.

The self adjusting action of the automatic clearance adjuster hereinbefore described with reference to FIGS. 7 to 10 is due to the special geometry of the buttress screw thread forms and may be equally advantageously utilised in a push rod operated overhead valve engine or in an overhead camshaft engine e.g., of the type illustrated with respect to FIG. 5. A typical geometry of the thread forms would be characterised by a high helix H of approximately 14° and an asymmetric thread form having a low flank angle $G_R$ of approximately 5° and a high flank angle $G_L$ of approximately 78°.

Referring again to FIGS. 7 and 8, the screw portion 30 is always spring loaded in the direction S by the spring 40 to produce contact between the low angle flanks of the screw threads. If there should be any clearance in any part of the valve system, the threaded portion 30 immediately takes up this clearance by rotating and advancing axially of the bushing 31 in the direction of arrow S. The spring 40 is able to move the threaded portion 30 in this manner because of the high helix angle H and because the low angle thread flanks offer a relatively low frictional resistance.

Thus the automatic clearance adjuster always eliminates any tendency for clearance to begin to form between (a) the cam and the cam follower (b) the cam follower and the push rod (c) the push rod and the rocker arm; and (d) the rocker arm and the valve stem.

However there is always a controlled axial gap between the co-operating buttress screw threads and the magnitude of this gap is governed entirely by the tolerances to which the co-operating threads are manufactured. Thus this axial gap always ensures that the valve is fully closed when the cam is on its low radius profile; thus when cam rotation begins to lift the push rod, the threaded portion 30 has to rise through the axial gap before the rocker arm can begin to open the valve.

When the threaded portion 30 has been raised through this axial gap in this manner, the high angle flanks of the co-operating screw threads are in contact with one another. The high flank angle $G_L$ has the effect of increasing the co-efficient of friction between the screw threads by a factor of approximately 4.8 ($1/\cos G_L$). Thus, in spite of the high helix angle H, there can be no relative motion between the co-operating screw threads as the lift of the push rod is transmitted directly to the rocker arm to open the valve.

It will be appreciated that the automatic clearance adjuster of FIGS. 7 to 10 will not only counteract any tendency for valve clearances to increase but will also counteract any tendency for valve clearances to decrease providing the cam 24 is ground to produce rotation of the push rod 22 in the direction which would tend to screw the threaded portion 30 upwards i.e., the direction of rotation indicated by the arrow in FIGS. 7 and 8. Similar self adjusting properties would also be obtainable from the optimised buttress thread forms when used in the valve operating mechanism of an overhead camshaft engine as illustrated in FIG. 5.

I claim:

1. A valve operating mechanism for a poppet valve of an internal combustion engine including a cam rotatable to apply lifting forces to the valve through the intermediary of an automatic clearance adjuster;

the adjuster including two components arranged for transmission of the valve lifting forces from the cam to the valve and comprising co-operating screw threads of buttress thread form so formed as to provide a predetermined axial free play between the two components;

axially directed spring loading means acting between the components in a sense opposite to the transmission of valve lifting forces between the components such that, when no valve lifting force is being tramsmitted from the cam, the spring loading urges the threads axially into engagement so that the reactions between the engaged threads causes relative rotation of the two components to take up rotational positions such that the clearance in the mechanism is equal to the predetermined axial free play between the screw buttress threads;

the buttress thread form of each said component having a helix angle H, a first flank termed the running flank and having angle $G_R$ and a second flank termed the locking flank and having angle $G_L$ satisfying the conditions that:

(a) $\tan H > \mu_{MAX} \sec G_R$ (b) $\tan H < \mu_{MIN} \sec G_L$ and (c) $\cot G_L > \mu_{MAX} \cos H$ where $\mu_{MAX}$ and $\mu_{MIN}$ are respectively the highest and lowest expected values of the co-efficient of friction between the co-operating flanks of the threads of said components whereby the screw buttress threads exhibit a high friction between the locking flanks having said second flank angle $G_L$ under valve lifting forces transmitted from the cam compared with the friction between the running flanks having said first flank angle $G_R$ under forces transmitted from the spring loading; whereby upon application of valve lifting forces by the cam the locking flanks frictionally engage and prevent rotation between the components, and when the cam applies no valve lifting forces but the spring applies axially directed loading means acting between the two components the resulting frictional engagement between running flanks permits rotation between the components and an increase in their overall relative length until clearance in excess of the buttress thread free play clearance is eliminated.

2. A mechanism as claimed in claim 1 wherein the helix angle H lies between 10° and 20°; the first flank angle $G_R$ lies between 0° and 5°; and the second flank angle $G_L$ lies between 70° and 80°.

3. A mechanism as claimed in claim 1 wherein the cam is so shaped as to impart rotation to one component relative to the other component of the automatic clearance adjuster during the transmission of valve lifting forces, the direction of rotation being opposite to that imparted to said one component under forces transmitted from the spring loading.

* * * * *